US006901635B1

(12) United States Patent
Scola

(10) Patent No.: US 6,901,635 B1
(45) Date of Patent: Jun. 7, 2005

(54) SHOPPING BAG CARRIER

(76) Inventor: Vito A. Scola, 137 Apple Gate Rd., Cranston, RI (US) 02920

( * ) Notice: Subject to any disclaimer, the term of this patent is extended or adjusted under 35 U.S.C. 154(b) by 0 days.

(21) Appl. No.: 10/775,512

(22) Filed: Feb. 10, 2004

(51) Int. Cl.[7] ..... A45C 3/04; A45F 5/10

(52) U.S. Cl. ..... 16/422; 16/428; 16/114.1; 294/137; 294/171

(58) Field of Search ..... 16/422, 428, 444, 16/446, 114.1, 406; 294/25, 27.1, 137, 141–143, 294/166–167, 170–171; 383/13–16, 21–24; D8/300, 303, 306, 395–396; D9/434, 455; 248/215, 218.2, 99, 100, 101

(56) References Cited

U.S. PATENT DOCUMENTS

| | | | | | |
|---|---|---|---|---|---|
| 2,642,581 | A | * | 6/1953 | Loe | 4/577.1 |
| 3,692,218 | A | | 9/1972 | Friedman | |
| 3,912,140 | A | | 10/1975 | Franges | |
| 3,913,172 | A | * | 10/1975 | Richards et al. | 16/411 |
| 4,004,722 | A | | 1/1977 | Olivier | |
| 4,071,063 | A | * | 1/1978 | Russell | 383/7 |
| 4,112,541 | A | | 9/1978 | Tetradis | |
| D268,815 | S | | 5/1983 | Schwalbach | |
| 4,558,896 | A | | 12/1985 | Farnworth | |
| 4,596,397 | A | * | 6/1986 | Conti | 280/47.131 |
| 4,772,059 | A | | 9/1988 | Parry et al. | |
| 4,936,619 | A | * | 6/1990 | Salazar | 294/171 |
| 4,946,065 | A | * | 8/1990 | Goulter et al. | 220/495.1 |
| 4,982,989 | A | | 1/1991 | Sweeny | |
| 5,005,891 | A | * | 4/1991 | Lunsford | 294/171 |
| 5,026,105 | A | | 6/1991 | Feldman | |
| 5,150,938 | A | | 9/1992 | Gans | |
| 5,356,190 | A | | 10/1994 | Torres | |
| 5,411,307 | A | | 5/1995 | Roberts | |
| 5,651,575 | A | * | 7/1997 | Bystrom et al. | 294/171 |
| 5,658,029 | A | | 8/1997 | Franko | |
| 5,667,266 | A | | 9/1997 | Giocanti | |
| 5,797,166 | A | * | 8/1998 | Wagenheim | 16/443 |
| 5,836,634 | A | | 11/1998 | Finkelman | |
| 6,049,948 | A | * | 4/2000 | Leonardi | 16/428 |
| 6,354,645 | B2 | | 3/2002 | Bozlee | |
| 6,378,925 | B1 | * | 4/2002 | Greenlee | 294/171 |
| 6,481,771 | B1 | | 11/2002 | Friedman | |
| D480,645 | S | | 10/2003 | Putnam | |
| 6,711,784 | B2 | * | 3/2004 | Walker | 16/436 |
| D497,255 | S | * | 10/2004 | Scola | D3/328 |

FOREIGN PATENT DOCUMENTS

| | | | | |
|---|---|---|---|---|
| FR | 2 541 099 | | 8/1984 | |
| FR | 2 659 626 | | 9/1991 | |
| FR | 2 661 323 | | 10/1991 | |
| FR | 2700449 | A1 * | 7/1994 | A45F 5/10 |
| GB | 2146615 | A * | 4/1985 | B65D 33/06 |
| GB | 2 218 901 | | 11/1989 | |
| GB | 2 230 940 | | 11/1990 | |
| GB | 2 263 228 | | 7/1993 | |

* cited by examiner

*Primary Examiner*—Chuck Y. Mah
(74) *Attorney, Agent, or Firm*—Salter & Michaelson

(57) ABSTRACT

A shopping bag carrier includes a carrying handle adapted to be gripped by a user, a hook extending from the handle, and a locking member supported on the hook and engageable with a locking surface of the handle so as to secure the one or more bags within the hook. In one embodiment, the carrier is preferably rigid in construction, and is made as a single, unitary member. In another embodiment, the locking member is preferably locked and unlocked by a release member using a simple action so that a user can perform the operation with one hand.

15 Claims, 7 Drawing Sheets

SHOPPING BAG CARRIER

DESCRIPTION

1. Technical Field

This invention relates generally to a shopping bag carrier, and more particularly, to a carrying handle for supporting and carrying bags, such as plastic shopping bags.

2. Background of Related Art

It is common for grocery stores, department stores, and the like to pack their products in plastic shopping bags. These plastic bags generally include a pair of loops which form handles for the consumers to carry the bags. While convenient, the looped handles tend to cut into the hand of consumers, making the bags uncomfortable to carry. This is especially true when carrying multiple bags or bags which are particularly heavy. It is therefore desirable to provide a device capably of carrying one or more bags, and heavy bags in a more comfortable manner. Over the years several devices have been developed in an attempt to achieve the goal of providing a comfortable handle for carrying plastic shopping bags, or the like.

One such device is disclosed in UK Patent Application GB 2,230,940. This application discloses a device for carrying bags which has a handle portion (1) that can be grasped by the hand of a user, and a hook portion (2) on which the shopping bags can be hung. While generally effective, the UK '940 patent fails to disclose a locking member for securing the handles of the bag within the hook portion. As such, the bags may rest on the hook in an unstable and insecure fashion.

Another device for carrying cartons, bags or the like is disclosed in U.S. Design Pat. No. 268,815 to Schwalbach. This design patent discloses a handle which snaps shut in order to secure the handle in a closed position. However, because of the faces of the handle are parallel planes and snap together, this handle does not appear to leave sufficient room for carrying multiple bags in a comfortable manner.

Likewise, U.S. Pat. No. 4,004,722 to Oliver also discloses a handle device for carrying packages or the flexible straps of shopping bags. This handle, like UK '940, does not include any locking mechanism in which to secure the bags within the handle.

Finally, U.S. Pat. No. 4,558,896 to Farnsworth discloses a handle for carrying loads that includes a grip and a strap extending from the grip. The strap is lockable within the grip in order to form a loop that can be used to hold a load. However, the Farnsworth device appears to be made of a flexible plastic material which may also become uncomfortable to grip due to twisting which may occur when holding heavy loads.

All of the above-described devices provide a degree of comfort and support for carrying shopping bags, or other articles such as packages. However, there is continued need in the art for a device which can comfortably aid in carrying shopping bags and the like, and which is capable of carrying multiple bags and/or bags filled with heavy loads.

SUMMARY

One object of the present invention is to provide a shopping bag carrier which can comfortably and reliably support multiple bags, or a single heavily loaded bag, without producing undue strain on a user's hand. The shopping bag carrier preferably includes a carrying handle adapted to be gripped by a user, a hook extending from the handle, and a locking member supported on the hook and engageable with a locking surface of the handle so as to secure the one or more bags within the hook. In one embodiment, the carrier is preferably rigid in construction, and is made as a single, unitary member. In another embodiment, the locking member is preferably locked and unlocked by a release member using a simple action so that a user can perform the operation with one hand.

BRIEF DESCRIPTION OF THE DRAWINGS

It should be understood that the drawings are provided for the purpose of illustration only and are not intended to define the limits of the invention. The foregoing and other objects and advantages of the embodiments described herein will become apparent with reference to the following detailed description when taken in conjunction with the accompanying drawings in which.

DETAILED DESCRIPTION OF THE ILLUSTRATIVE EMBODIMENTS

Figure 1:
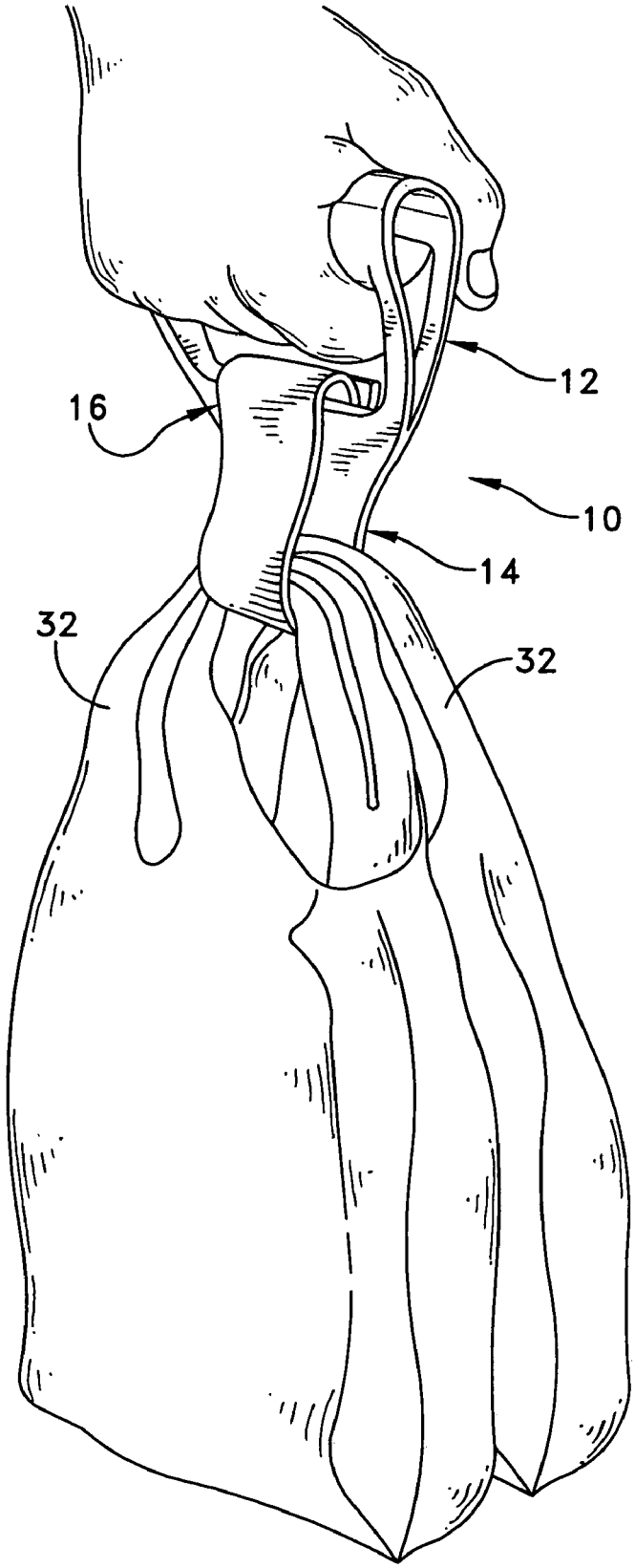
FIG. 1 is a perspective view of the shopping bag carrier in use with multiple bags.
Figure 2:
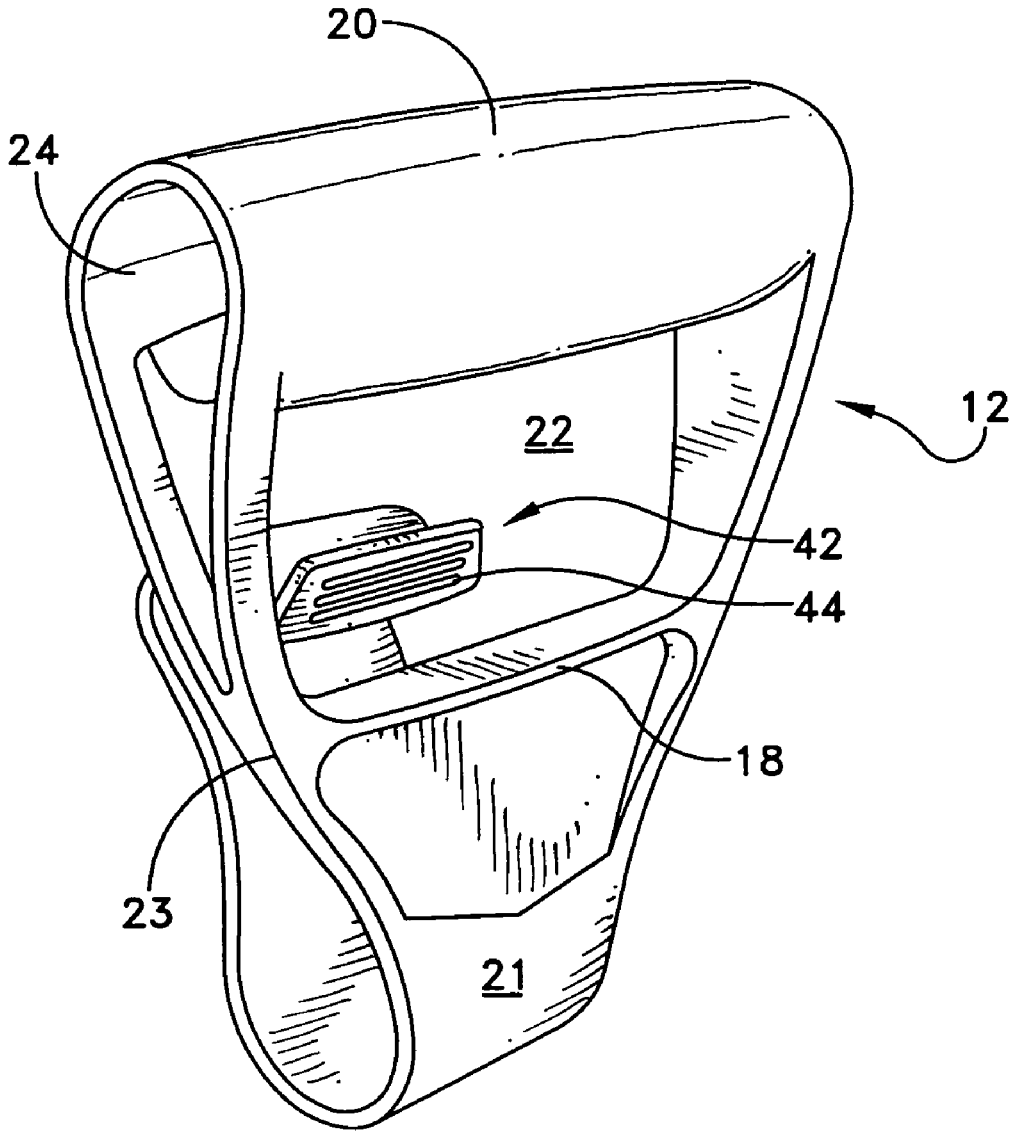
FIG. 2 is a rear perspective view of the shopping bag carrier of FIG. 1 in an unlocked position.
Figure 3:
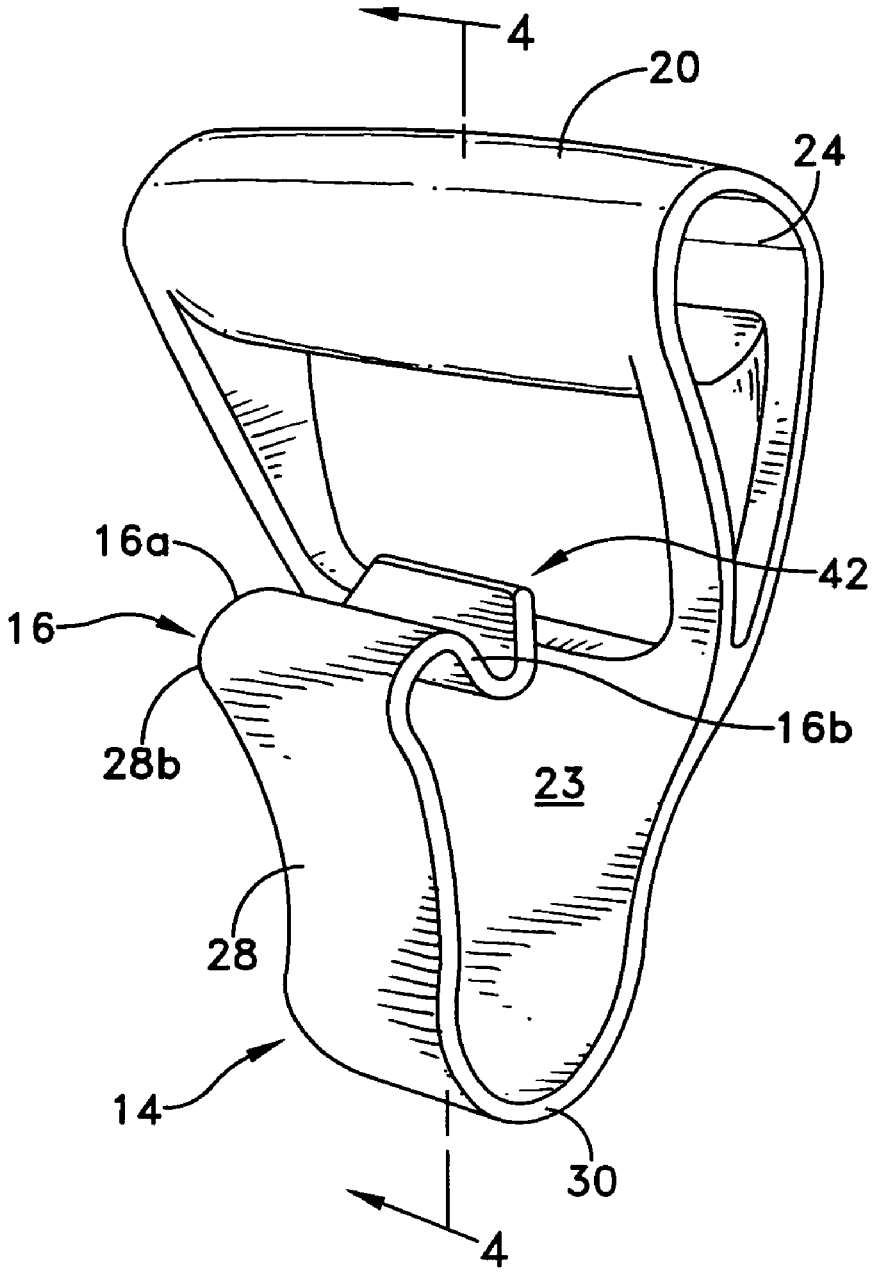
FIG. 3 is a front perspective view of the shopping bag carrier of FIG. 1 in an unlocked position.

A shopping bag carrier 10 for supporting one or more shopping bags to be carried by a consumer is illustrated in FIGS. 1–7. The carrier 10 includes a handle 12 constructed and arranged to be grasped by a user, a hook 14 extending from the handle, and a locking member 16 which is engageable with a locking lip 18 of the handle 12 in order to lock the hook into a closed position during use. The handle, hook and locking member are preferably formed as a unitary member. The hook 14 is supported by the handle 12, and the locking member 16 extends from the hook and is releasably engageable with the locking lip 18 of the handle, as described in greater detail below.

The handle 12 preferably includes a gripping member 20 which is designed to be grasped by a consumer and a body portion 23 for supporting hook 14. The gripping member 20 is preferably cylindrical in shape and may include multiple curvatures on underside 20*a* sized to receive the individual fingers of the consumer's hand (not shown). The gripping member may further include a hollow portion 24, in order to decrease the overall weight of the carrier. An opening 22 is disposed through the handle between the gripping member 20 and body portion 23. The opening 22 is preferably sized to receive the fingers of an average consumer as well as locking member 16, such that the fingers do not engage the locking member while the carrier is in use. A locking lip 18 is preferably supported adjacent and below the opening along an outer surface 21 of body portion 23 of the handle. The locking lip 18 is engaged by the locking member during use in order to secure the hook in a closed position, as described in greater detail below. In the present embodiment, the handle preferably has a unitary, one-piece construction, i.e. it does not open, so that the handle is secure when grasped by the user.

Hook 14 preferably extends from the body portion 23 and has a generally "J" shaped configuration in the open position (FIG. 3) defined by outer leg 28 and a curved base 30 which is positioned between body portion 23 and outer leg 28. The hook is sized to receive two or more plastic shopping bag handles 32 which rest at the base 30 of the "J" during use. Because of the locking and unlocking motion during use, the base 30 is preferably constructed to withstand repetitive opening and closing of the hook. In particular, the base is preferably curved as illustrated to withstand the repetitive opening and closing. Supported on an upper end 34 of leg 28 is locking member 16. Outer leg 28 is generally rigid in order to support the weight of the one or more bags in the locked position.

Locking member 16 is supported at a first end 16*a* by the second end 28*b* of the leg 28 of hook 14, and is engageable at a second end 16*b* with locking lip 18 in order to lock the hook in a closed position during use. The locking member 16 further includes an inner surface 36, an outer surface 38 and a curvature 40 defined by the inner and outer surfaces. In the present embodiment, the curvature of the locking member is preferably inverted with respect to the curvature of the base of the hook, as illustrated. The inverted curvature allows the inner surface of the locking member to extend over the locking lip 18 and engage the locking lip 18 at the second end 16*b* of the locking member 16. To engage the locking lip 18, the locking member 16 is moved in the direction of arrow "B" by the consumer. Once engaged, the hook will remain in the closed position until released by the consumer.

Figure 4:
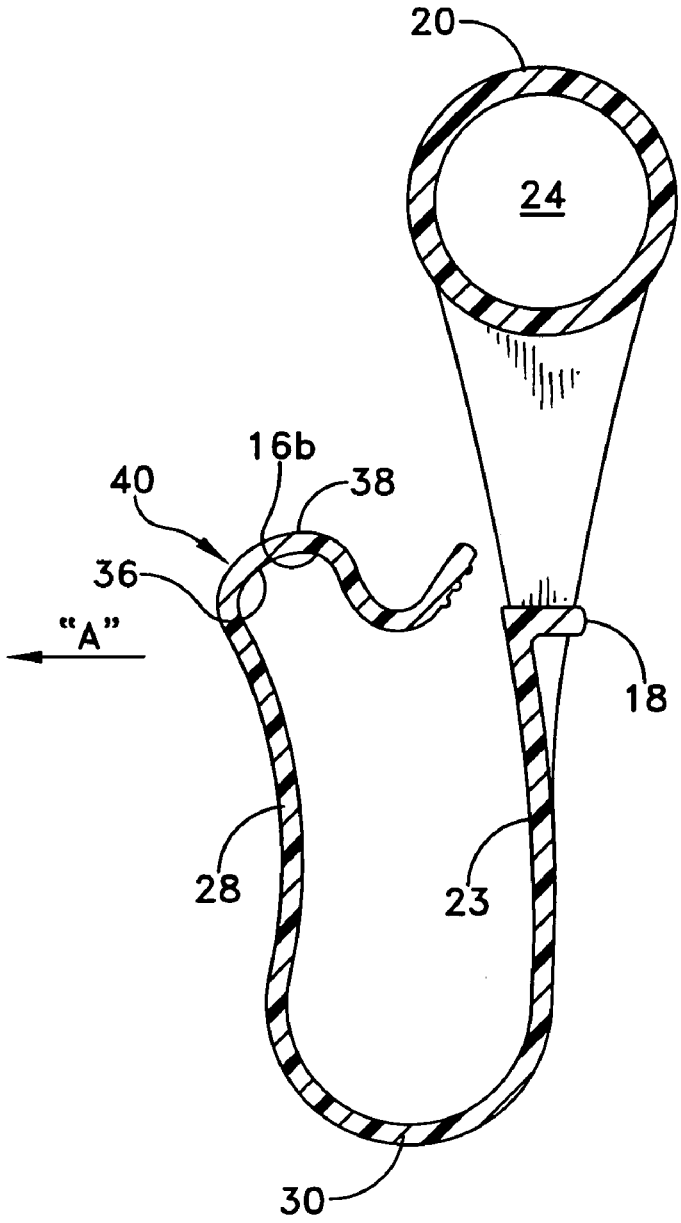
FIG. 4 is a cross-sectional view taken along lines 4—4 of FIG. 3.
Figure 5:
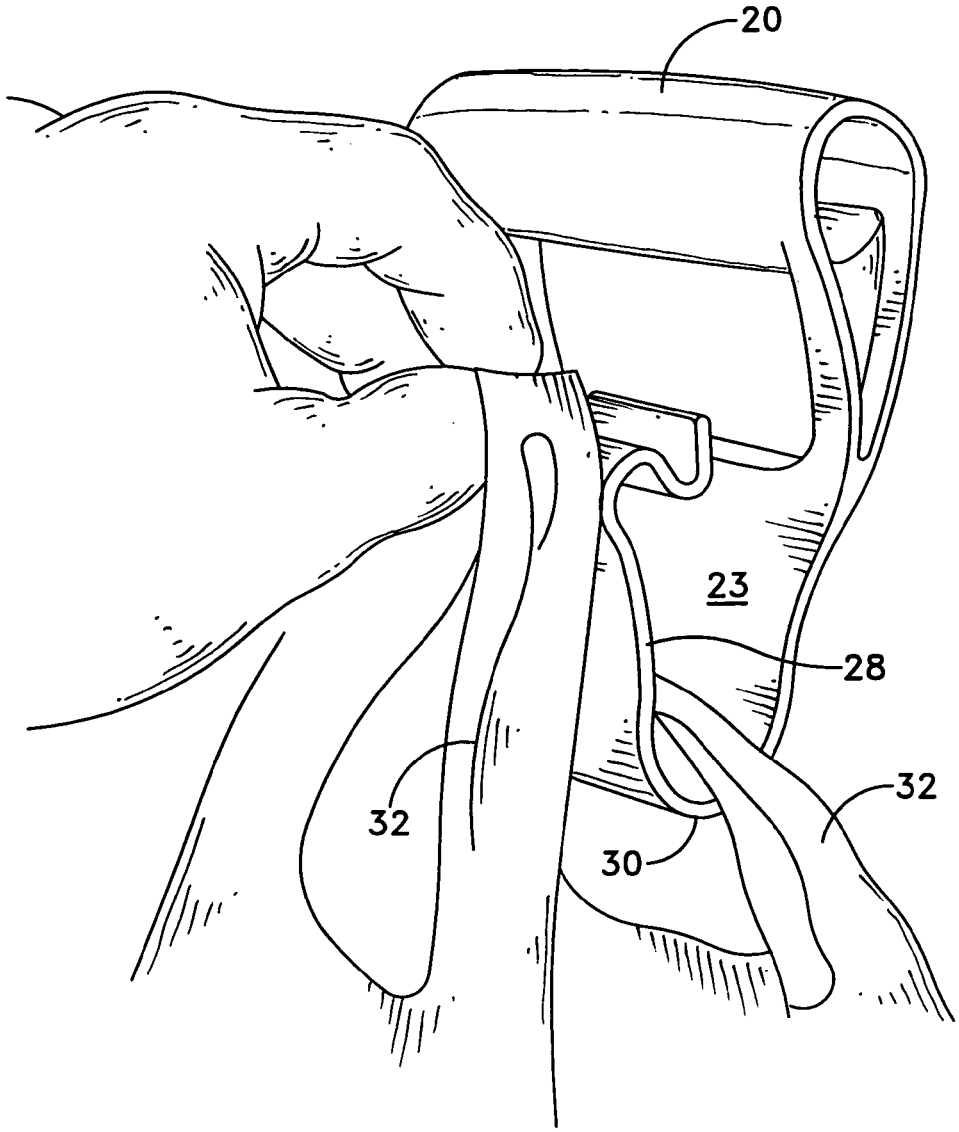
FIG. 5 is a perspective view showing the loading of bags onto the shopping bag carrier of FIG. 1.
Figure 6:
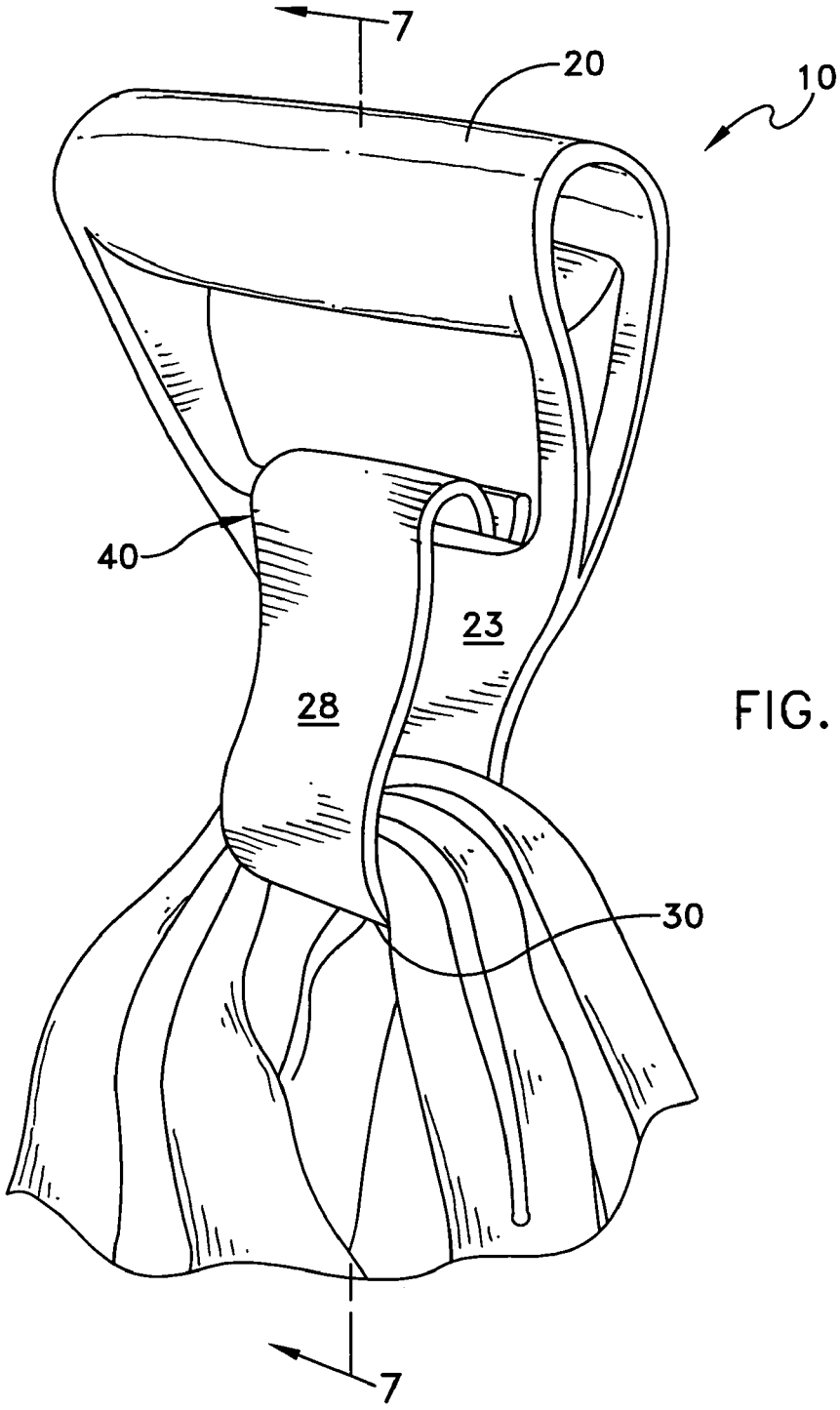
FIG. 6 is a front perspective view of the shopping bag carrier in the locked position holding multiple bags.
Figure 7:
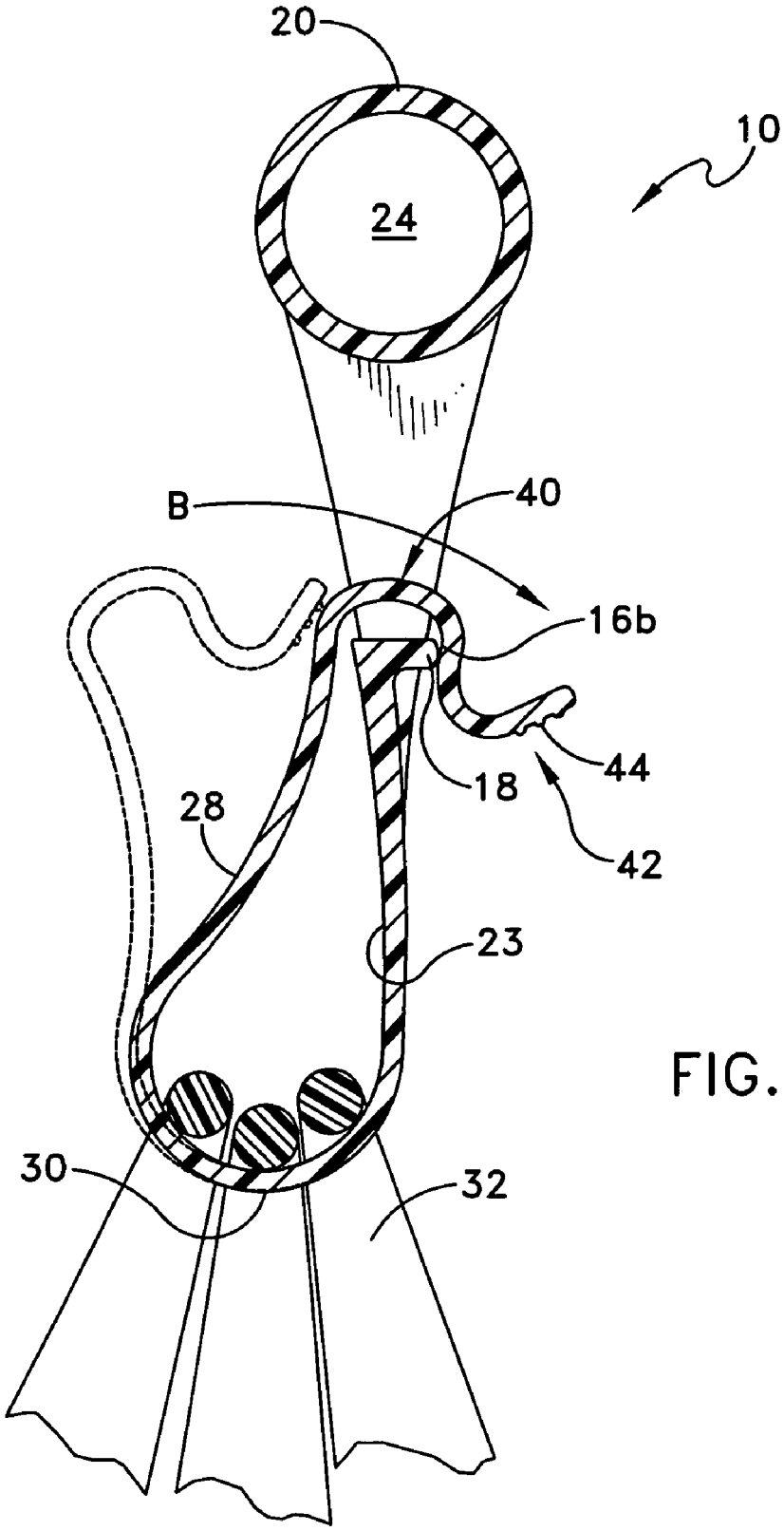
FIG. 7 is a cross-sectional view taken along lines 7—7 of FIG. 6.

Extending from and supported by the second end 16*b* of the locking member 16 is release member 42. Release member 42 is constructed to be engaged by the user in order to unlock the hook from the handle so that the bags may be removed therefrom. In the present embodiment, the release member 42 extends upward from the second end of the locking member, toward the grip, and may further include a textured surface 44 to prevent slipping when engaged. In order to disengage the locking member, the user engages the locking member, for example with their thumb, and forces the locking member outward, in the direction of arrow "A" (FIG. 4). As the locking member is forced in the direction of arrow "A", the inner surface of the locking member is disengaged from the locking lip 18. A gap is then formed between the hook and the handle so that the bags can be removed from the handle. The design of the locking member allows the user to unlock the hook, while holding the handle, all with a single hand.

In the present embodiment, handle, hook, locking member, and the release member are all preferably formed as a unitary member. It is also preferred that the handle, hook and locking member are made of a generally rigid plastic material so that the carrier can support heavily weighted bags without twisting uncomfortably in the user's hand.

It will be appreciated that the shopping bag carrier disclosed herein can comfortably and reliably support multiple bags, or a single heavily loaded bag, without producing undue strain on a user's hand. In addition, because it is lockable, the bags supported therein will not inadvertently slip out of the handle.

It will be understood that various modifications may be made to the embodiment disclosed herein. For example, the shape and size of the handle may be varied, as would be known to those of skill in the art. Therefore, the above description should not be construed as limiting, but merely as exemplifications of a preferred embodiment. Those skilled in the art will envision other modifications within the scope spirit of the invention.

I claim:

1. A carrier for supporting and carrying bags having handles, the carrier comprising:

a handle including a gripping member constructed and arranged to be grasped by a user, an opening, a body portion, and a locking lip supported adjacent and below the opening on an outer surface of the body portion;

a hook having a base extending from and supported by the handle, the base including a curvature constructed and arranged to support the handles of the carrying bag, the hook further including a rigid outer leg having a first end which extends from the curved base and a second end opposite the first end;

a locking member having a first end supported by the second end of the outer leg, a second end engageable with the locking lip of the handle in order to lock the hook into a closed position during use, an inner surface, and an outer surface; and a release member constructed and arranged to release the locking member from engagement with the handle.

2. The carrier of claim 1, wherein the locking member includes a curvature defined between the inner and outer surface which is inverted with respect to the base curvature of the hook.

3. The carrier of claim 1, wherein the release member extends upward from the second end of the locking member, toward the handle, and is engageable by the thumb of the user while holding the gripping member.

4. The carrier of claim 1, wherein the handle, hook, locking member, and release member are formed as a single, unitary member.

5. The carrier of claim 1, wherein the gripping member further includes a hollow portion.

6. The carrier of claim 1, wherein the hook includes a generally "J" shaped configuration in the open position, defined by the outer leg and the curved base.

7. The carrier of claim 1, wherein the inner surface of the locking member extends over and engages the locking lip so as to secure the hook in the closed position.

8. The carrier of claim 1, wherein handle, hook and locking member are made of a generally rigid plastic material so that the carrier can support heavily weighted bags.

9. A carrier for supporting and carrying bags having handles, the carrier comprising:

a handle including a gripping member constructed and arranged to be grasped by a user, an opening, a body portion, and a locking lip supported adjacent and below the opening on an outer surface of the body portion;

a hook having a base extending from and supported by the handle, the base including a curvature constructed and arranged to support the handles of the carrying bag, the hook further including a rigid outer leg having a first end which extends from the curved base and a second end opposite the first end;

a locking member having a first end supported by the second end of the outer leg, a second end engageable with the locking lip of the handle in order to lock the hook into a closed position during use, an inner surface, an outer surface, and a curvature defined between the inner and outer surface which is inverted with respect to the base curvature of the hook; and a release member constructed and arranged to release the locking member from engagement with the handle.

10. The carrier of claim 9, wherein the release member extends upward from the second end of the locking member, toward the handle, and is engageable by the thumb of the user while holding the gripping member.

11. The carrier of claim 9, wherein the handle, hook, locking member, and release member are formed as a single, unitary member.

12. The carrier of claim 9, wherein the gripping member further includes a hollow portion.

13. The carrier of claim 9, wherein the hook includes a generally "J" shaped configuration in the open position, defined by the outer leg and the curved base.

14. The carrier of claim 9, wherein the inner surface of the locking member extends over and engages the locking lip so as to secure the hook in the closed position.

15. The carrier of claim 9, wherein handle, hook and locking member are made of a generally rigid plastic material so that the carrier can support heavily weighted bags.

* * * * *